US005513839A

United States Patent [19]

Green

[11] Patent Number: 5,513,839

[45] Date of Patent: May 7, 1996

[54] DUAL MODE SET STACKING TAMPER AND SHEET FEEDER OFFSET SYSTEM

[75] Inventor: Frederick A. Green, Fairport, N.Y.

[73] Assignee: Xerox Corporation, Stamford, Conn.

[21] Appl. No.: 311,662

[22] Filed: Sep. 23, 1994

[51] Int. Cl.[6] ..... B42B 5/00; B65H 31/36

[52] U.S. Cl. ..... 270/53; 270/58; 271/221; 271/207; 414/907

[58] Field of Search ..... 271/221, 220, 271/253, 254, 314, 207, 238, 240; 414/907, 789.1, 791.2; 270/53, 58

[56] References Cited

U.S. PATENT DOCUMENTS

| | | | |
|---|---|---|---|
| 4,073,391 | 2/1978 | O'Brien et al. | 271/221 X |
| 4,188,025 | 2/1980 | Gusfafson et al. . | |
| 4,318,539 | 3/1982 | Lamos . | |
| 4,480,825 | 11/1984 | Landa | 271/314 X |
| 4,712,786 | 12/1987 | Looney | 271/207 |
| 4,858,909 | 3/1988 | Stemmle . | |
| 4,861,213 | 8/1989 | Fuchs . | |
| 5,007,625 | 4/1991 | Kremers et al. . | |
| 5,037,081 | 8/1991 | Engelhardt et al. . | |
| 5,044,625 | 9/1991 | Reid . | |
| 5,288,062 | 2/1994 | Rizzolo et al. . | |
| 5,328,169 | 7/1994 | Mandel . | |
| 5,385,340 | 1/1995 | Hiroi et al. . | |

FOREIGN PATENT DOCUMENTS

| | | | |
|---|---|---|---|
| 62-16982 | 1/1987 | Japan | 271/314 |
| 62-41130 | 2/1987 | Japan | 271/221 |
| 62-41131 | 2/1987 | Japan | 271/221 |
| 2-23150 | 1/1990 | Japan | 271/220 |
| 3-267266 | 11/1991 | Japan . | |
| 452950 | 5/1975 | U.S.S.R. | 271/221 |

*Primary Examiner*—John E. Ryznic

[57] ABSTRACT

In an output system for handling the printed sheets sequentially outputted by a reproduction apparatus, including at least one output stacking tray, and at least one exit rollers sheet ejection system for ejecting the printed sheets into said output stacking tray, and further including an intermediate compiler tray with an edge tamping system including a tamper drive, a selectable mechanical interconnection system between the tamper drive and the exit roller sheet ejection system selectably laterally offsets the exit rollers sheet ejection system with the tamper drive upon lateral movement beyond a preset lateral position, into a non-stacking position, for selected printed sheets, so that these selected printed sheets may be stacked partially laterally offset from other sheets in a stack in the output stacking tray. The edge tamping system and the exit roller sheet ejection system may both be mounted on a movable compiling and finishing module to move in linear parallel paths.

9 Claims, 3 Drawing Sheets

DUAL MODE SET STACKING TAMPER AND SHEET FEEDER OFFSET SYSTEM

Cross-reference is hereby made to a commonly assigned copending application on a dual mode tamper/offsetter by Barry P. Mandel, filed Jul. 5, 1994 as application Ser. No. 08/270,350.

By way of background, a stack edge "tamper" system normally repeatedly reversibly moves one or more generally vertical tamper arms or walls against one or both sides of a set of sheets being compiled in the compiler or other tray, as the individual sheets enter the tray to stack therein. The tamper system normally must also reset, adjust or otherwise allow for different size sheets being stacked. Another name for a tamper is a "jogger", although the latter term can encompass different stacking assistance devices, such as top sheet feeder/flappers, and the like. Tamping causes the stack of sheets to stack squarely superposed in a single regular stack in a single defined or registration position.

The term "offsetting" generally relates to a different function. With regard to stacking, it refers to deliberate irregular stacking of plural job sets so that each separate job set is slightly laterally offset from adjacent job sets. That is, with a edge of one job set extending out by one or more centimeters over the same edge of the underlying set from which it is desired to be distinguished, or vice versa, etc.. (However, each offset job set itself normally comprises squarely stacked plural sheets.)

Offsetting output jobs has several known advantages. The job sets are much more easily distinguished from one another and separated, especially unbound sets. As for stapled sets (or other bound sets), stacking stapled sets with the staples directly on top of one another (without offsetting) can undesirably result in what is called staple build up, which can limit total stapled set capacity in the stacking tray, and cause other problems, because the stack height increases in that area of the staples and becomes uneven.

Heretofore, these different tamping and offsetting functions were done in an unrelated manner by different systems and mechanisms. With the present dual mode system, their hardware, and especially the tamper drive system, can be partially shared for cost savings. The disclosed dual mode tamping system can provide stack tamping in a first mode, and sheet offsetting in a second mode. The dual mode system disclosed in the embodiments herein can provide both tamping of plural sheets in a compiler for stapling and offsetting of outputted sheets with the same or a partially shared system.

A specific feature of the disclosed embodiments is to provide in an output system for handling the printed sheets sequentially outputted by a reproduction apparatus, including at least one output stacking tray, and at least one exit rollers sheet ejection system for ejecting said printed sheets into said output stacking tray, and further including an intermediate compiler tray with an edge tamping system including a tamper drive for moving said edge tamping system, in which compiler tray a set of said printed sheets may be compiled and aligned by edge tamping the sheets with said edge tamping system before being fully ejected into said output stacking tray, the improvement comprising a selectable mechanical interconnection system between said tamper drive and said exit rollers sheet ejection system for selectably laterally offsetting said exit rollers sheet ejection system with said tamper drive for selected said printed sheets in said exit rollers sheet ejection system so that said selected printed sheets may be stacked partially laterally offset from other said printed sheets in a stack of said printed sheets in said output stacking tray.

Other disclosed features include, individually or in combination, those wherein said edge tamping system and said exit rollers sheet ejection system are mounted to move in linear paths which are parallel to one another; and/or wherein said edge tamping system and said exit rollers sheet ejection system are commonly mounted on a movable compiling and finishing module which is movable relative to plural said output stacking trays to provide selectable lateral offset stacking of said printed sheets in plural said plural stacking tray outputs; and/or wherein said tamping system comprises a dual racks and central pinion system with tampers mounted to said racks, and said tamper drive comprises a motor driving said pinion, and wherein a lug on one of said racks is positioned to engage and laterally shift a connecting member connecting with said exit rollers sheet ejection system upon lateral movement of said rack beyond a preset lateral position; and/or wherein said reproduction apparatus is a shared user printer, and said output stacking tray comprises a selected one of plural mailboxes for different said shared users; and/or wherein said edge tamper system includes a spaced pair of upstanding sheet tampers between which said printed sheets may be compiled, and said tamper drive comprises a dual mode tamper drive system, wherein in a first mode at least one of said tampers is driven towards the other said tamper to tamp said print job set into a squared stack in a defined stacking and tamping position in said compiler tray and wherein in a second mode said dual mode tamper drive system causes said tampers to move to a non-stacking position; and/or wherein said tamper drive has a single drive motor; and/or wherein said exit rollers sheet ejection system comprises a pair of commonly axially shiftable roller shafts with feed wheels for feeding sheets from said compiler to said output stacking tray which change the offset of sheets therein by said axial shifting; and/or further including a stapling system for stapling a print job set in said compiler tray, and wherein said same exit rollers sheet ejection system ejects said stapled print job set without offsetting.

Further by way of background, some examples of patents relating to single set edge tamping include U.S. Pat. Nos. 5,044,625; 5,288,062; 5,188,353; 3,860,127; 4,134,672; 4,477,218; 4,480,825; 4,616,821; 4,925,172; 4,925,171; 5,098,074, and art cited therein. As noted in some of these tamping system patents, in in-bin sorter stapling systems, the tamper provides what may be called offsetting of the single set into a stapler, but that is single, stapling position, stacking registration, not the type of variable or plural position offset stacking discussed above.

Some examples of patents relating to offsetting of plural job set stacks from one another in an output stack include U.S. Pat. Nos. 4,480,825 and 4,712,786 with axial roller lateral sheet shifting; and other offsetting systems such as U.S. Pat. Nos. 4,157,059; 4,188,025; 4,318,539; 4,858,909; 4,861,213; 5,007,625; 5,037,081; and Japanese published application No. 3-267266 published Nov. 28, 1991. Further in regard to job offsetting, automatically stacking more than one unstapled copy set into sorter bins, with set offsetting, by bin side-shifting for increased bin capacity, is described in a Xerox Disclosure Journal publication Vol. 14, No. 1, Jan./Feb. 1989, p. 29; and U.S. Pat. No. 4,688,924. The latter and U.S. Pat. No. 5,128,762 teach process-direction set offsetting. That is, individual job sets partial offsetting in the rearward or process (input) direction from other otherwise commonly stacked job sets.

As disclosed in this and other prior art, it is known that offsetting can be done by lateral or process direction incremental shifting or partial rotation of the output stacking tray, or reciprocal lateral shifting of individual sheets being outputted, as by axial shifting of the output or ejecting rollers.

By way of further background, compiler/stapler units with means for registration of one set at a time for stapling or other finishing, and then ejection of each set onto a stacking tray, preferably an elevator tray, are also well known, and some additional examples include those disclosed in Xerox Corporation U.S. Pat. Nos. 5,098,074; 5,288,062; 5,303,017 and 5,308,058; and also U.S. Pat. No. 5,137,265.

The disclosed embodiment may be used in a "mailbox" system in which there are plural selectable output trays comprising mailbox bins for separate users of a shared user printer. Further details thereof, including the FIGS. 3 and 4 embodiment thereof herein with its compiler/stapler unit are disclosed in Xerox Corporation U.S. Pat. No. 5,328,169 issued Jul. 12, 1994.

Further by way of background, especially as copiers and printers increase in speed and capabilities, it is desirable for their paper handling and output to be more automated and made more reliable in general. "On-line finishing" is one means for such improvements. It may be roughly defined as a system in which the document pages being copied are printed in a order such that each copy set or job set comes out precollated, and thus can be automatically finished (stapled, glued or otherwise bound) in collated sets without manual handling or post-collation, starting immediately with the first set, and while subsequent copy sets of that same job are being printed by that reproduction apparatus. Preferably the finisher is integral, or a separable module at the output of, the reproduction apparatus for directly sequentially receiving the individual sheets as soon as they are printed.

Xerox Corporation patents on the general subject of generating collated signatures at a copier output include, e.g., U.S. Pat. Nos. 4,727,402 issued to R. E. Smith Feb. 23, 1988; 4,925,176 issued May 15, 1990 to T. Acquaviva (see Cols. 3–4); 4,814,822; and 5,241,474; and other art Also noted re signatures copying or printing are U.S. Pat. Nos. 4,727,402; 5,108,081; 5,080,340; 4,988,029; 4,891,681; 5,161,724; 4,595,187; and 4,592,651.

The present system may, of course, be optionally combined or provided with an orbiting nip or other optional sheet output inverter and/or plural mode or other alternative outputs for unbound sheets, etc., as disclosed in U.S. Pat. No. 5,201,517.

It is also additionally noted that combined facsimile and/or digital scanning, copying and printing (and even optional conventional light lens or digital direct copying) can be provided in a known manner in an integral or multifunctional unit which may also be encompassed by the term "printer" as used herein.

The disclosed apparatus may be readily operated and controlled in a conventional manner with conventional control systems, such as the above and other existing ones in printers, copiers, and their controllers, e.g., U.S. Pat. No. 4,475,156 and art cited therein. It is well known in general and preferable to program and execute such control functions and logic with conventionally written software instructions for conventional microprocessors. This is taught by various patents and commercial printers. Such software may of course vary depending on the particular function and the particular software system and the particular microprocessor or microcomputer being utilized, but will be available to or readily programmable by those skilled in the applicable arts without undue experimentation from either verbal functional descriptions, and/or drawings, such as those provided herein, together with general knowledge in the software and computer arts. Controls may alternatively be provided utilizing various other known or suitable hard-wired logic or switching systems. The job set printing, finishing, and or other instructions and controls can be provided locally on the printer and/or the subject signature finishing module, or remotely.

As to other specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of these embodiments thereof, including the drawing figures wherein:

As particularly shown in the example of the Figures, and described further herein, the present system can be utilized as shown in these examples for a center registered system, with two tampers or sets of tampers, respectively on opposite sides of the job stack being compiled. For tamping they may be driven by the same tamper drive system towards and away from one another for square stacking of a job set in one stacking position. Alternatively, the present dual mode system can also be used for a front or rear registered (side registered) paper path, with a single tamper tamping sheets on one side of the stack towards a fixed registration wall on the other side of the stack. Also disclosed is a system for ejecting the entire compiled stack onto a stacking tray without losing lateral registration. Offsetting of selected sheets can be provided by axially shifting the output rollers with the tamper system, as disclosed.

Figure 3:
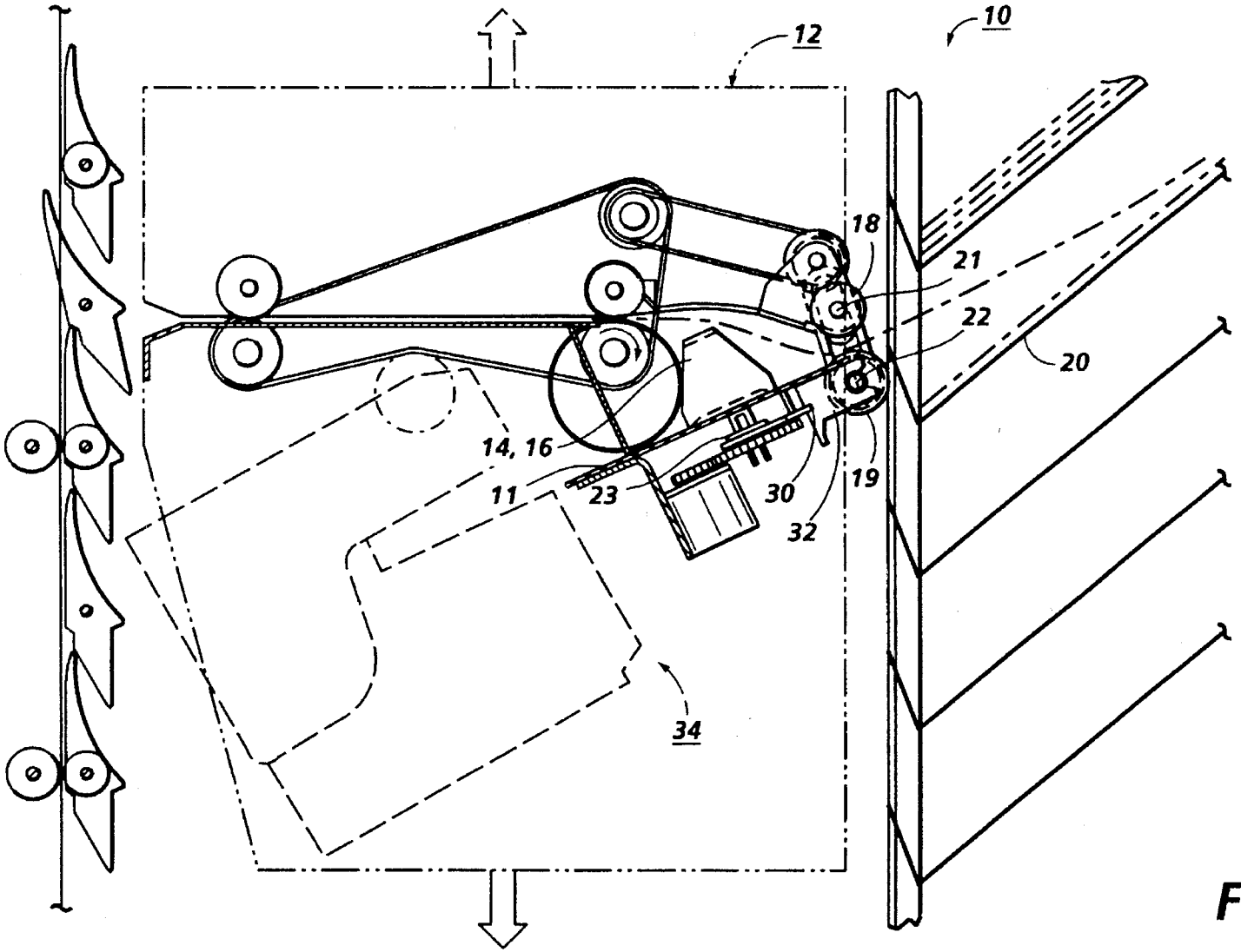
FIG. 3 is a partial schematic side view of the system of FIGS. 1 and 2 in a moveable compiler/stapler module of a plural bins mailbox system.
Figure 4:
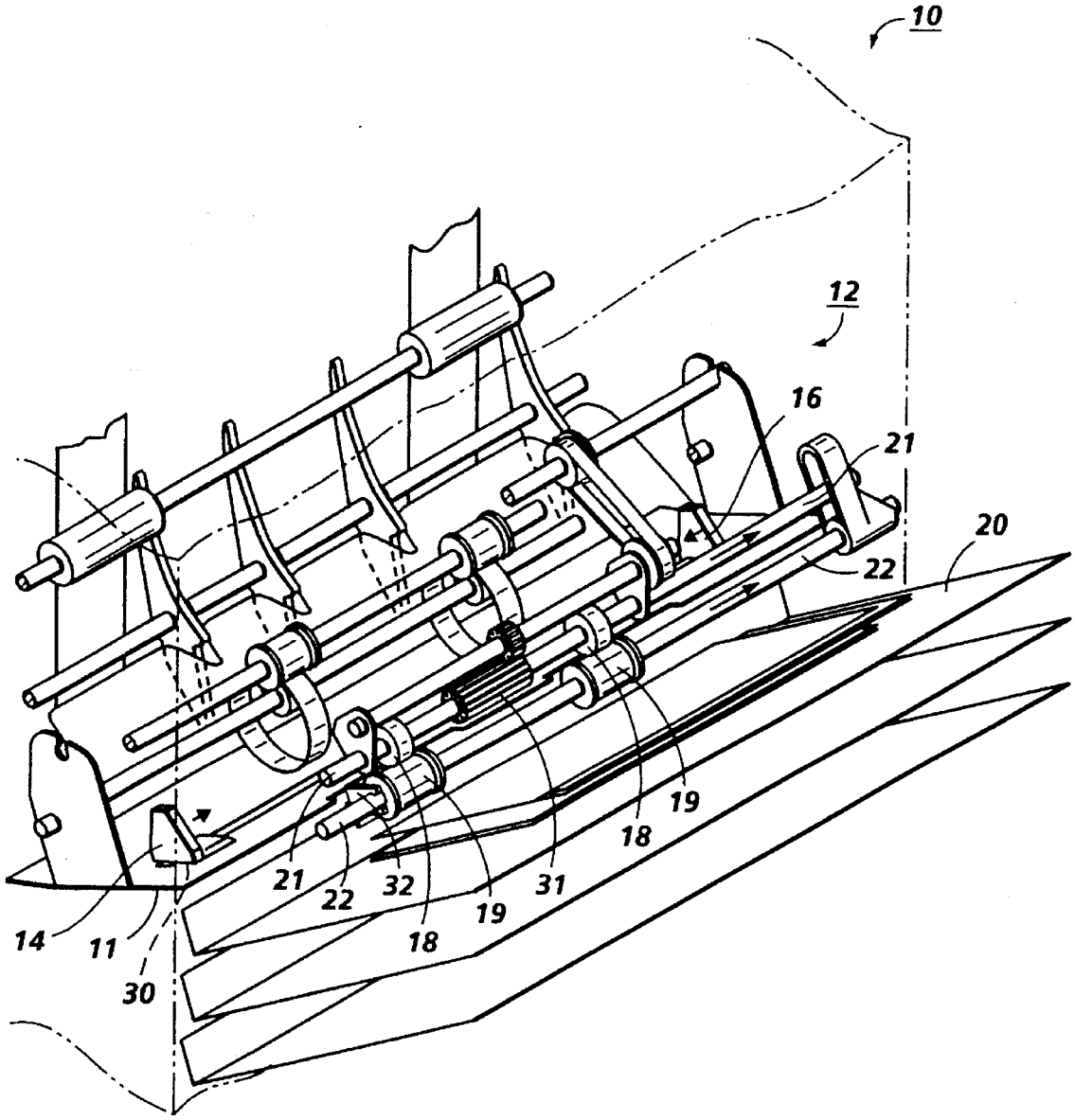
FIG. 4 is a frontal partial perspective view of the embodiment of FIG. 3.

Referring first however to FIGS. 3 and 4, the output system 10 example here is directly adjacent an electronic printer or other reproduction apparatus capable of producing and/or sequentially outputting printed sheets to be sequentially received by the system 10 compiler unit 12. The printer may be conventional, and thus need not be further described herein. The cited and other art provides examples and alternatives.

Figure 1:
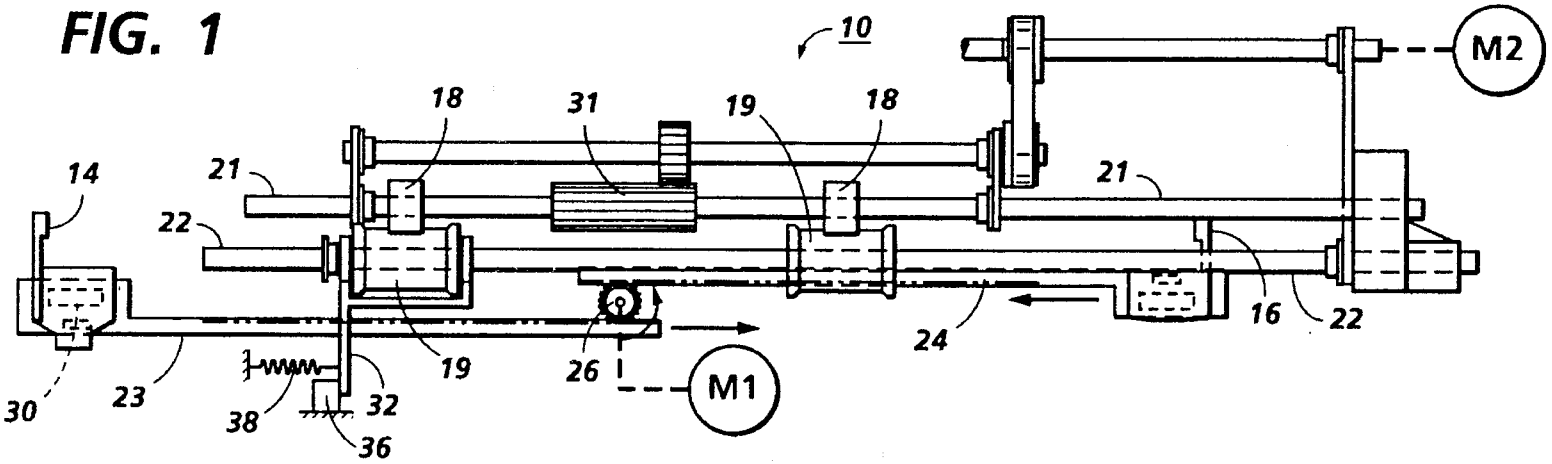
FIG. 1 is a schematic frontal view of one exemplary sheet output system incorporating one example of the subject dual mode compiler tamper and sheet output offsetting system in a tamper mode.
Figure 2:
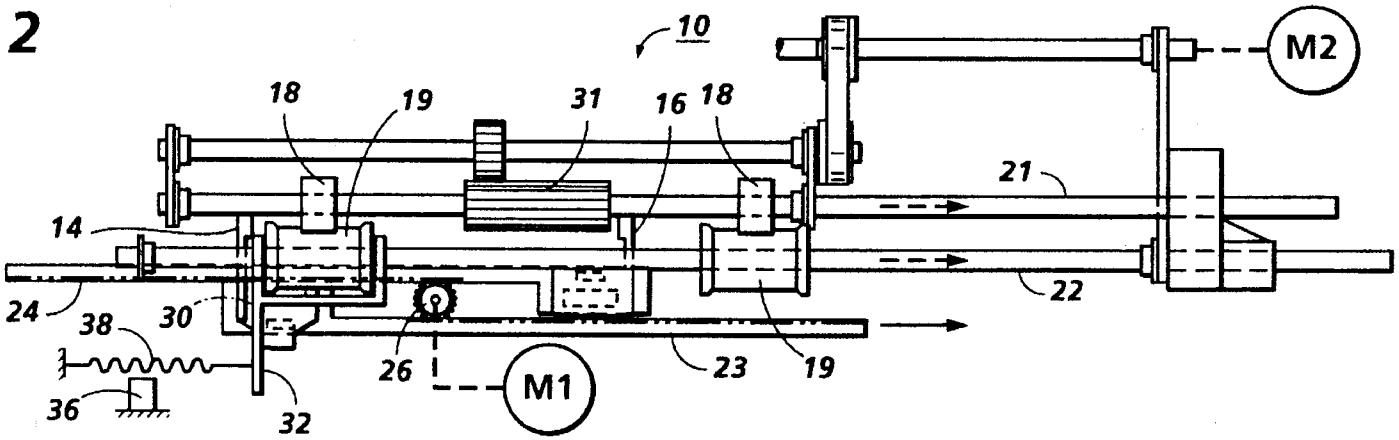
FIG. 2 is the same as FIG. 1 but is shown in a sheet output offsetting mode.

Referring especially to FIGS. 1 and 2, there is shown here one example 10 of a dual mode tamper drive system and dual mode tamper system. The exit rollers 18, 19 or sheet set ejection system may be an openable nip system, as further described in the above-cited U.S. Pat. No. 5,328,169. The compiled set feedout provided by the set ejection rollers may be a non-skewing feedout from the compiler, so the set lateral position provided in the compiler may be retained as the job set is fed to the output stacking tray. This, and other known features of this example, need not be described in detail herein. It will be appreciated that this is merely one application of the subject dual mode mechanism. The systems described here, and many mechanical alternatives thereof which will be apparent from this disclosed function, can provide automatic tamping of the stacked set in various compilers before the set is stapled and ejected, or ejected unstapled. The system 10 provides normal stack tamping in a first mode, and then selectable positions of output stack offsetting in a second mode, as further discussed herein. In the first mode, as will be described, rotation of a tamper drive motor M1 in one direction moves tamper 14 towards tamper 16, to provide tamping. Rapid reversals of motor M1's driving direction can provide a rapid tamping action as each sheet enters the compiler tray 11 to stack. Reversal of motor M1 moves the tampers apart, and that may also be used to initially set the tamper spacing to the size sheets being tamped. Motor M1 is controlled by the machine's conventional programmed microprocessor controller, as described above. All of this dual mode tamper drive system mechanism can be mounted underneath the compiler tray 11, except for the portion of the tampers 14 and 16 projecting up through a slot in the tray 11 bottom to engage the sheets stacked thereon.

In the embodiment herein, center registration stacking of sheets is conventionally provided in compiler tray 11 by a well-known dual rack 23, 24 and center pinion 26 connection of the side-guides and tampers 14, 16 of the compiler unit 12, so that the side guide tampers 23, 24 automatically move together to always center the job sheet stack irrespective of its size. Rotation of pinion 26 moves the linear geared racks 23, 24 on opposite sides thereof in opposite directions. This is for center registration, and for edge registration, modifications such as those described above can be made.

In this embodiment 10, normally only sheets to be stapled, and not others, are compiled in the compiler tray 11 of the compiler unit 12 tamped with edge tampers 14 and 16, and stapled by a stapler 34. As noted, these compiler tray tampers (edge walls or fingers) 14 and 16 here may be snap fitted into respective tray-underlying racks 23, 24 of a standard dual rack and center pinion 26 system, in which the tampers 14 and 16 move towards one another when the pinion 26 is rotated in one direction by a tamper drive motor M1, or away from one another when the pinion 26 is reversed. This dual rack and center pinion system is like that of a conventional tray side guides mounting for center registration tray systems. (In the later systems, however, the pinion is not driven.) For tamping a set being compiled in the compiler tray 11, the tamper drive motor M1 first laterally moves the tampers 14 and 16 apart by the selected sheet dimension, then repeatedly bi-directionally rotates the pinion 26 to move the tampers reciprocally about 11 mm for tamping.

However, sheets not being stapled are individually bypassed here directly on into the adjacent mailbox bin or other output stacking tray 20 over the top of the compiler unit 12 and fed out by the illustrated exit feeding rolls 18, 19 on shafts 21, 22. Thus, these unfastened sheet sets being accumulated directly in output tray 20 have a particular need for job sets offsetting.

When the compiler tray 11 is thus being bypassed, and offsetting is desired of selected sheets being sent to a selected mailbox bin or other output stacking tray 20 for unstapled stacking, then the tamper drive motor M1 here unconventionally reversibly rotates the pinion 26 much further, to a non-tamping position, different from any selectable sheet dimension. In this extended non-tamping position of the tamper system here, a lug or cam 30 on one of the racks 23 is driven into engagement with a yoke 32, which yoke 32 in turn laterally shifts both of the output rollers shafts 21 and 22 while a sheet is in their output rollers 18, 19 nip. See the difference in position in FIG. 2 versus FIG. 1, and the movement arrows. This output nip shift lateral shifting provides offset of that sheet in the nip as the sheet outputs, (as is known per se from the cited and other art). The shafts 21 and 22 are returned to a normal stop 36 position by spring 38 when the tampers return to an operative position. These units may be commonly mounted as a single module, and have parallel movement. The illustrated spline drive 31 of shaft 21 from motor M2 continues an interrupted drive of the rollers 18, 19 during this lateral shift.

As shown in FIGS. 1 and 2, the two shafts 21 and 22 have an end coupling which allows their rotation but ensures that they laterally move together. This end coupling has a slot which allows the upper shaft to be vertically lifted relative to the lower shaft when the exit rollers nip needs to be opened.

Note that the tampers 14 and 16 here only engage sheets during tamping, and do not engage any sheets during this described offsetting. In fact, the tampers 14, 16 are too close together (or far apart) to do so in this second mode. Too close is preferable, as then the tops of these side guides 14, 16 can help support sheets being fed thereover to the output tray. Yet the same tamper drive motor M1 is used in both cases, to provide a dual mode function. That is, tamping stacking sheets in the compiler to be stapled in a first mode, and offsetting sheets being outputted without stapling in a second mode simply by moving with the tamping system M1 laterally beyond its normal tamping range.

As noted, further description of details of the sheet input to the compiler tray 11 and stacking and stapling therein is described in said U.S. Pat. No. 5,328,169, and also in the art cited therein, and need not be described in detail herein.

It will be appreciated from this teaching that various alternatives, modifications, variations or improvements in the disclosed embodiments may be made by those skilled in the art, which are intended to be encompassed by the following claims.

I claim:

1. In an output system for handling the printed sheets sequentially outputted by a reproduction apparatus, including at least one output stacking tray, and at least one exit rollers sheet ejection system for ejecting said printed sheets into said output stacking tray, and further including an intermediate compiler tray with an edge tamping system including a tamper drive for moving said edge tamping system, in which compiler tray a set of said printed sheets may be compiled and aligned by edge tamping the sheets with said edge tamping system before being fully ejected into said output stacking tray, the improvement comprising a selectable mechanical interconnection system between said tamper drive and said exit rollers sheet ejection system for selectably laterally offsetting said exit rollers sheet ejection system with said tamper drive for selected said printed sheets in said exit rollers sheet ejection system so that said selected printed sheets may be stacked partially laterally offset from other said printed sheets in a stack of said printed sheets in said output stacking tray.

2. The printed sheets handling output system of claim 1, wherein said edge tamping system and said exit rollers sheet ejection system are mounted to move in linear paths which are parallel to one another.

3. The printed sheets handling output system of claim 1, wherein said edge tamping system and said exit rollers sheet ejection system are commonly mounted on a movable compiling and finishing module which is movable relative to plural said output stacking trays to provide selectable lateral offset stacking of said printed sheets in plural said plural stacking tray outputs.

4. The printed sheets handling output system of claim 3, wherein said reproduction apparatus is a shared user printer, and said output stacking tray comprises a selected one of plural mailboxes for different said shared users.

5. The printed sheets handling output system of claim 1, wherein said tamping system comprises a dual racks and central pinion system with tampers mounted to said racks, and said tamper drive comprises a motor driving said pinion, and wherein a lug on one of said racks is positioned to engage and laterally shift a connecting member connecting with said exit rollers sheet ejection system upon lateral movement of said rack beyond a preset lateral position.

6. The printed sheets output handling system of claim 1, wherein said edge tamper system includes a spaced pair of upstanding sheet tampers between which said printed sheets may be compiled, and said tamper drive comprises a dual mode tamper drive system, wherein in a first mode at least one of said tampers is driven towards the other said tamper to tamp said print job set into a squared stack in a defined stacking and tamping position in said compiler tray and wherein in a second mode said dual mode tamper drive system causes said tampers to move to a non-stacking position.

7. The printed sheets output handling system of claim 1, wherein said tamper drive has a single drive motor.

8. The printed sheets output handling system of claim 1, wherein said exit rollers sheet ejection system comprises a pair of commonly axially shiftable roller shafts with feed wheels for feeding sheets from said compiler to said output stacking tray which change the offset of sheets therein by said axial shifting.

9. The printed sheets output handling system of claim 1, further including a stapling system for stapling a print job set in said compiler tray, and wherein said same exit rollers sheet ejection system ejects said stapled print job set without offsetting.

* * * * *